US012703973B2

(12) United States Patent
Boot et al.

(10) Patent No.: US 12,703,973 B2
(45) Date of Patent: Aug. 11, 2026

(54) INTERLOCKING CONSTRUCTION BLOCKS

(71) Applicant: SAMARAEE & DANIEL INNOVATION SPECIALISTS INCORPORATED, Comox (CA)

(72) Inventors: Daniel Anthony Leonard Boot, Comox (CA); Muayad S. Dawood Al-Samaraee, Muratpasa (TR)

(73) Assignee: SAMARAEE & DANIEL INNOVATION SPECIALISTS INCORPORATED, Comox (CA)

( * ) Notice: Subject to any disclaimer, the term of this patent is extended or adjusted under 35 U.S.C. 154(b) by 0 days.

(21) Appl. No.: 19/352,301

(22) Filed: Oct. 7, 2025

(65) Prior Publication Data

US 2026/0035911 A1 Feb. 5, 2026

Related U.S. Application Data

(62) Division of application No. 17/826,892, filed on May 27, 2022.

(51) Int. Cl.

| | |
|---|---|
| ***E04B 2/22*** | (2006.01) |
| ***E04B 2/18*** | (2006.01) |
| *E04B 2/02* | (2006.01) |

(52) U.S. Cl.

CPC ..... *E04B 2/18* (2013.01); *E04B 2/22* (2013.01); *E04B 2002/0213* (2013.01); *E04B 2002/0226* (2013.01); *E04B 2002/0263* (2013.01)

(58) Field of Classification Search

CPC .... A63H 33/08; A63H 33/082; A63H 33/084; A63H 33/086; E04B 2/18; E04B 2/14;

(Continued)

(56) References Cited

U.S. PATENT DOCUMENTS 1,356,590 A * 10/1920 Baumann ..... E04B 2/22 52/574
3,076,293 A * 2/1963 Baudoux ..... E04B 2/16 52/439

(Continued)

FOREIGN PATENT DOCUMENTS

CN 205369676 U 7/2016
WO WO-2008151403 A1 * 12/2008 ..... E04B 2/26
WO 2021080252 A1 4/2021

*Primary Examiner* — Kyle J. Walraed-Sullivan
(74) *Attorney, Agent, or Firm* — David J. McGruder, Oyen Wiggs Green & Mutala LLP

(57) ABSTRACT

The present invention is an improvement on a previous version of an interlocking building block system for use in constructing a building wall. The improvements introduced are radii corners and chamfered edges that allow for claddings to be attached to the wall by leaving space for mechanical screws to be secured between two blocks. Furthermore, the radii corners allowed for increased mechanical movement between two interlocking blocks, resulting in greater durability of the blocks. The improvement also include a corner block and an intersecting block which replace the need for using multiple blocks to create intersecting points or corners. Some blocks also contain an additional hollow cavity with channels to allow increased support members to be introduced between blocks, thus increasing the height of the walls that can be built using the block system.

1 Claim, 5 Drawing Sheets

(58) Field of Classification Search
CPC ..... E04B 2/16; E04B 2/32; E04B 2/46; E04B 2002/0202; E04B 2002/0204; E04B 2002/0206; E04B 2002/021; E04B 2002/0208; E04B 2002/0213; E04B 2002/0215; E04B 2002/0217; E04B 2002/0219; E04B 2002/0223; E04B 2002/0221; E04B 2002/0226; E04B 2002/0228; E04B 2002/0232; E04B 2002/0234; E04B 2002/0236; E04B 2002/0239; E04B 2002/0263
See application file for complete search history.

(56) References Cited

U.S. PATENT DOCUMENTS 3,557,505 A * 1/1971 Kaul ..... E04B 2/30 52/249
3,562,988 A * 2/1971 Gregiore ..... E04B 2/12 52/590.3
3,562,989 A * 2/1971 Gregiore ..... E04B 7/107 52/570
4,003,172 A * 1/1977 Pawl ..... E04B 2/08 52/610
4,633,630 A * 1/1987 Kindylides ..... E04B 2/50 52/204.2
4,704,832 A * 11/1987 Vassiliadis ..... E04B 2/18 52/574
6,065,265 A 5/2000 Stenekes
6,508,041 B1 * 1/2003 Boot ..... E04B 2/18 52/603
7,185,470 B1 3/2007 Link
9,499,950 B1 11/2016 Smith
D833,644 S * 11/2018 Mohamed ..... D25/113
D835,295 S * 12/2018 Mohamed ..... D25/113
D835,298 S * 12/2018 Mohamed ..... D25/113
D835,808 S * 12/2018 Mohamed ..... D25/113
10,316,485 B1 6/2019 Ness
D857,925 S * 8/2019 Frank ..... D25/119
D857,926 S * 8/2019 Frank ..... D25/119
2003/0129919 A1 * 7/2003 Glickman ..... A63H 33/101 446/126
2010/0162649 A1 * 7/2010 Boot ..... E04B 2/26 52/607
2018/0222081 A1 * 8/2018 Mohamed ..... B29C 33/0033
2018/0223524 A1 * 8/2018 Mohamed ..... E04C 1/397
2019/0136518 A1 * 5/2019 Mohamed ..... B28B 1/14
2020/0282323 A1 9/2020 MacArthur
2021/0010220 A1 1/2021 Ness

* cited by examiner

INTERLOCKING CONSTRUCTION BLOCKS

CROSS-REFERENCE TO RELATED APPLICATION

This application is a divisional of U.S. application Ser. No. 17/826,892 filed May 27, 2022, entitled INTERLOCKING CONSTRUCTION BLOCKS which is hereby incorporated herein by reference for all purposes.

FIELD OF THE INVENTION

The present invention relates to an interlocking concrete construction block system for constructing walls and foundations for buildings.

BACKGROUND OF THE INVENTION

The inventors previously developed an interlocking dry-stack concrete masonry building system that incorporated the use of interlocking components to allow for the construction of walls that did not require reinforcement. Such blocks are used in the construction industry to build stable one-story walls that do not require the use of mortar.

SUMMARY OF THE INVENTION

The current invention is an improvement on the previous system in that it increases the number of blocks used in the system; incorporates vertical radius corners and vertical radius edges on the interlocking portions of the blocks, and chamfered edges to provide space between the block to accommodate mechanical fasteners to attach insulation and claddings to walls; and introduces an additional hollow cavity within the blocks to allow reinforcement of the blocks should construction of walls greater than one story be desired. In the alternative, such cavities can be used to run utilities through the walls.

The present invention is an improvement of an interlocking concrete masonry building system used for the construction of load bearing and non-load bearing masonry walls. The improvements include:

a) Vertical radius corners and vertical radius edges on the interlocking portions of the blocks, with radii in a range of 6 mm to 12 mm.
b) Chamfered edges on the blocks in a range of 2 to 4 degrees, optimally being 3 degrees, to allow space for mechanical fasteners between blocks that attach interior and exterior finishes;
c) Decreased block weight due to decreased material resulting from enlarged spaces within the blocks;
d) Radius corners and edges allow for greater flexion where blocks interact and as such decrease breakage when blocks are fit together;
e) Blocks with a hollow cavity that allows for optional increased reinforcement with the use of poured concrete and rebar, or provides passageways for the introduction of utility conduits when the blocks are used in a dry stack manner;
f) A unitary corner block as opposed to two blocks forming a corner;
g) An intersecting block that allows the wall to proceed in three different directions as opposed to two directions allowed in the original system;
h) End blocks with additional length and reinforcement.

The modular dimensions for the block of the present invention are nominally 399 mm long and 200 mm high with widths varying between 150 mm and 399 mm.

According to the present invention there is provided a first block for use in interlocking with other similar blocks in constructing a wall or building. The first block has a block body with a top and bottom surface both which are flat, an outer block wall making up one side of the block, an opposite side being the top of the head portion of the first block which contains a groove for retaining two abutment portions of two other blocks; two connecting portions on either side of the groove; a receiving portion on either side of the block head for retaining the connecting portions of other blocks; an abutment portion adjacent to each connecting portion that can be retained within the groove in the head of another block. The head portion has a hole located centrally thereof that extends from the top of the block through to the bottom of the block.

According to a second aspect of the invention there is provided an interlocking block system comprising a plurality of blocks arranged for use in interlocking with other similar blocks in constructing a building. The other blocks within the system consist of the same components of the first block, including the connecting, receiving, and abutment portions, but with these components being arranged in different numbers and orientations than that of the first block so as to allow the construction of a wall with intersecting points, end points, corners, and mirrored sections. All connecting portions, abutment portions, and receiving portions have radius corners and edges. All blocks contain grooves for retaining abutment portions.

A second style of block included in the system is comprised of two portions of approximately three quarters of one of the first blocks if bisected at a 45 degree angle to remove one of the connecting portions and shoulder abutments, being connected to form a right angled outer wall; a "w" shaped groove between the connecting portions; and wherein there are two holes from the top of the block to the bottom of the block, one each between an outer wall portion and the "w" shaped groove, and the holes are bisected by a connecting piece from the corner of the block to the underside of the center of the "w" shaped groove.

A third style of block included in the system that is an end block equal to one half of the other blocks.

A fourth style of block included in the system that is an extended end block wherein: the length of the outer wall of the end block is doubled; a groove substantially the shape of a shoulder abutment is created between the lobe shaped connector and a receiving portion between the end wall and head piece.

The second, third and fourth style of blocks can also be modified to contain a hollow chamber between the outer wall of the block and a separating wall placed between the hollow chamber and the remainder of the block. The hollow chambers may have channels that allow for the passing of rebar or utility conduits through these portions of the blocks. Alternatively, these hollow chambers can be used to place horizontal rebar and cement for increased reinforcement.

A fifth style of block included in the system that is an intersecting block comprised of the elements of one and a half of the first blocks wherein an element equal to one half of the first block is attached to the outer wall of a first block and configured such that the outer wall forms a right angle.

A sixth style of block included in the system that is a double sided block comprised of the elements of two of the first bocks configured such that the head portions are opposite each other, and the blocks are joined along what would be the outside walls.

In some aspects, the present invention provides a building block for use in interlocking with other similar blocks in constructing a building comprising: a block body having a top surface and a bottom surface, the block body having: an outer block wall defining one side surface of the block body; a head portion extending from the outer block wall toward an opposed side surface; and two connecting portions each on a respective side of the head portion; two abutment portions each at a respective end of the outer block wall and each defining a respective abutment shoulder; a single central groove in the head portion at a position thereon opposite to the outer block wall, the groove at opposite ends thereof defining two inwardly facing shoulders each for engaging and retaining the abutment portion of a respective one of two abutting blocks such that the abutment portions are retained end to end within the single groove; wherein there is defined between the abutment portion and the connecting portion a receiving portion complementary in shape to the connecting portion for receiving in interlocking relationship the connecting portion of a co-operating interlocking block; and wherein the linear corners and edges defined on the connecting portions are radius corners and edges.

In some embodiments, the radius corners and edges have a radius in the range of 6 mm to 12 mm.

In some embodiments, the groove has shoulders substantially at right angles to the outer block wall.

In some embodiments, the head portion has a hole centrally thereof and extending from the top surface to the bottom surface.

In some embodiments, the connecting portions are lobe shaped.

In some embodiments, the abutment shoulder edge is chamfered to define space with the abutment shoulder edge of an adjacent block into which claddings may be secured.

In some embodiments, the block further comprises a hollow cavity defined between the head portion and the outer wall.

In some embodiments, the shoulder abutments define a passage from one side of the block to the other and through the hollow cavity.

In some aspects, the present invention provides an interlocking block system comprising a plurality of blocks arranged for use in interlocking with other similar blocks in constructing a building, at least some of the blocks comprise: a block body having a top surface and a bottom surface, the block body having: an outer block wall defining one side surface of the block body; a head portion extending from the outer block wall toward an opposed side surface; two connecting portions each on a respective side of the head portion; two abutment portions each at a respective end of the outer block wall and each defining a respective abutment shoulder; a single central groove in the head portion at a position thereon opposite to the outer block wall, the groove at opposite ends thereof defining two inwardly facing shoulders each for engaging and retaining the abutment portion of a respective one of two abutting blocks such that the abutment portions are retained end to end within the single groove; wherein there is defined between the abutment portion and the connecting portion a receiving portion substantially matching in shape to the connecting portion for receiving in interlocking relationship the connecting portion of a co-operating interlocking block; and wherein the linear corners and edges defined on the connecting portions are radius corners and edges.

In some embodiments, the radius corners and edges have a radius in the range of 6 mm to 12 mm.

In some embodiments, the head portion has a hole centrally thereof and extending from the top surface to the bottom surface.

In some embodiments, the connecting portions are lobe shaped.

In some embodiments, the system includes a corner block comprised of two portions of approximately three quarters of one of the other blocks if bisected at a 45 degree angle to remove one of the connecting portions and shoulder abutments, being connected to form a right angled outer wall. In some embodiments, the corner block includes a "w" shaped groove between the connecting portions. In some embodiments, there are two holes, one each between an outer wall portion and the "w" shaped groove, and the holes being bisected by a connecting piece from the corner of the block to the underside of the center of the "w" shaped groove.

In some embodiments, the system includes an end block substantially equal to one half of the other blocks. In some embodiments, the length of the outer wall of the end block is doubled and a groove substantially the shape of a shoulder abutment is created between the lobe shaped connector and a connection between the end wall and head piece.

In some embodiments, the system includes blocks having a hollow cavity is defined by increasing the width of the shoulder abutments and inserting a dividing wall between the head piece and the cavity in the same position the outer wall previously occupied.

In some embodiments, the shoulder abutments contain a channel that allows access to the hollow cavity.

In some embodiments, the system includes an intersecting block being comprised of the elements of one and a half of the other blocks configured such that the outer wall forms a right angle and one head portion having an element shaped the same as an abutment portion on the side of the head portion equivalent to one half of the other block.

In some embodiments, the abutment shoulder edge is chamfered to define space with the abutment shoulder edge of an adjacent block into which claddings may be secured.

In some aspects, there is provided a building wall comprising a plurality of interlocking blocks, at least some of the blocks each comprising a top surface, a bottom surface, an outer block wall defining one side surface of the block body, a head portion extending from the outer block wall toward an opposed side surface, two connecting portions each on a respective side of the head portion, two abutment portions each at a respective end of the outer block wall and each defining a respective abutment shoulder, two connection portions each arranged between a respective one of the abutment portions and a respective one of the connecting portions, and a single central groove in the head portion at a position thereon opposite to the outer block wall, the groove at opposite ends thereof defining two inwardly facing opposed shoulders. The corners and edges are radius corners and edges. The blocks being arranged to define a first series of blocks in which the side surface of each of the first series of blocks is arranged to form a first vertical side surface of the wall and a second series of the blocks which are rotated through 180 degrees in which the side surface of each of the second series of blocks is arranged to form a second vertical side surface of the wall opposite to the first vertical side surface, the blocks being interlocked such that two abutment portions each of a respective one of two adjacent blocks of the second series fit into the single central groove in an opposed one of the blocks of the first series such that the abutment portion are retained end to end within the single groove. Two abutment portions each of a respective one of two adjacent blocks of the first series fit into the single central groove in an opposed one of the blocks of the second series such that the abutment portions are retained end to end within the single groove. Each receptacle of each of the first series of blocks is shaped to receive in interlocking relationship a respective one of the connecting portions of the second series of blocks. Where a corner block is used, the abutment portions each of a respective one of two adjacent blocks of the first series fit into either side of the "w" shaped groove of the corner block such that the outside corners of the abutment portions are opposite each other. Where an intersecting block is used, two abutment portions each of a respective one of two adjacent blocks of the first series fit into the single central groove in the head of the intersecting block and the abutment portion of a third block fits into a groove created between the lobe portion of the head of the half block portion and the outer wall of the full block portion of the intersecting block. Where an extended end block is used, the abutment portion of a block of the first series fits into the groove created between the lobe shaped connector and a connection between the end wall and head piece.

DESCRIPTION

DESCRIPTION OF THE PREFERRED EMBODIMENT OF THE INVENTION

Figure 1:
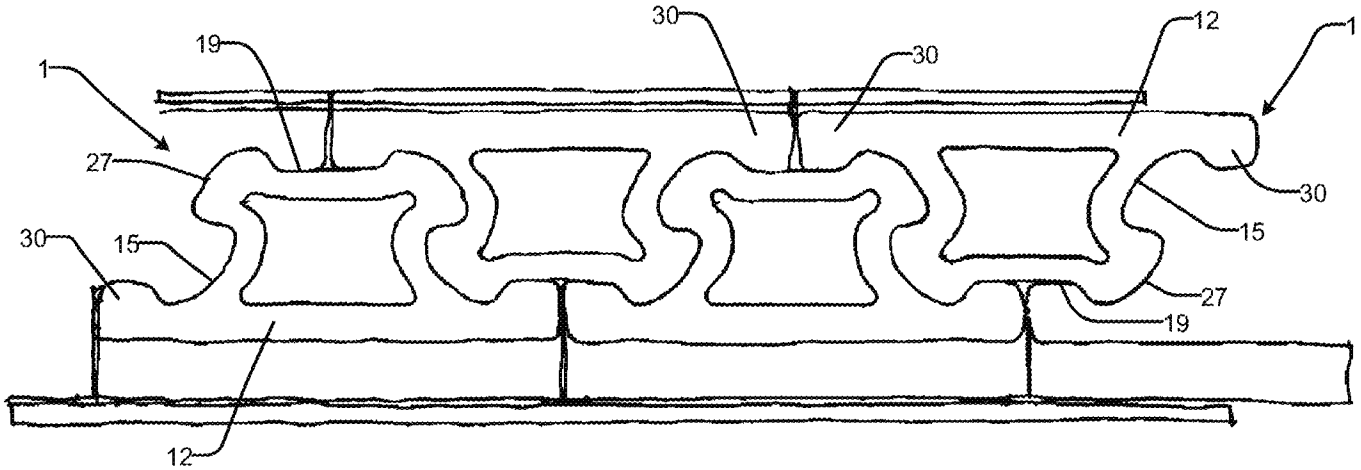
FIG. 1. is a top plan view of walls of a building which is constructed by the present invention with claddings attached by mechanical screws.
Figure 2:
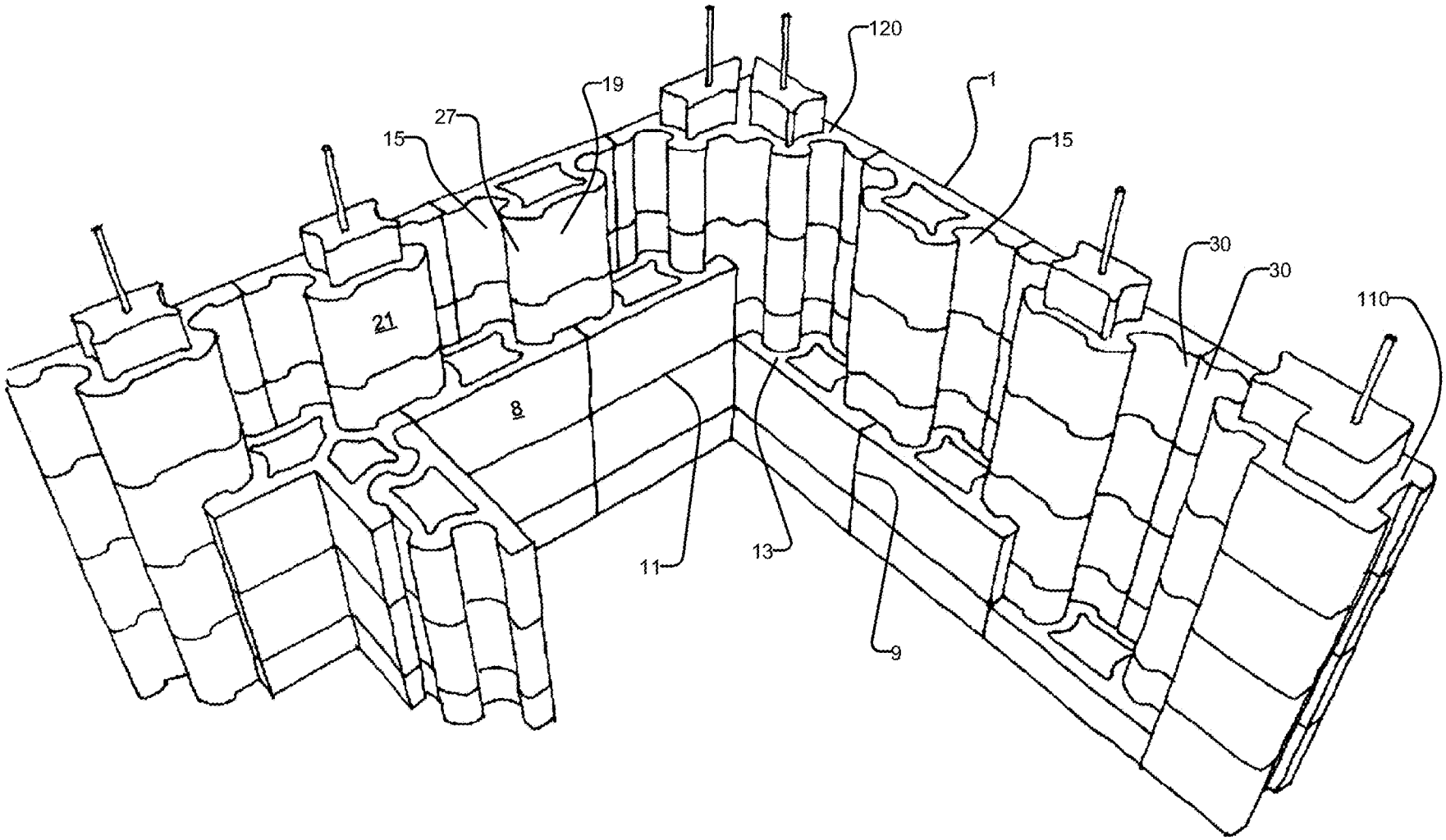
FIG. 2 is a perspective view of walls of a building which is constructed by the present invention and reinforced by concrete and rebar.
Figure 3:
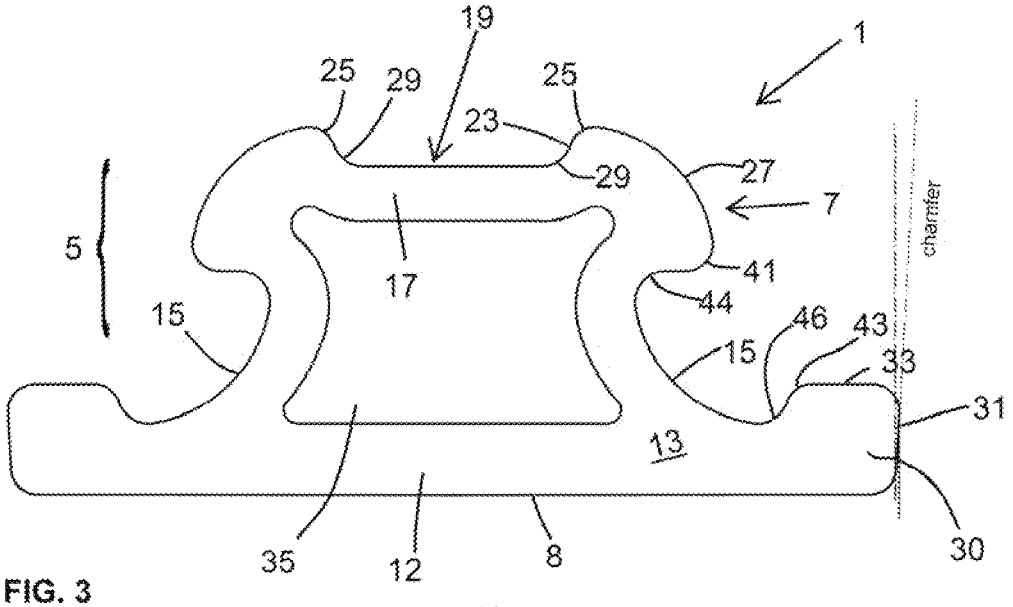
FIG. 3 is a top plan view of a standard building block of the present invention.

Referring to the accompanying drawings, there is illustrated in FIGS. 1, 2, and 3 an embodiment of a building block 1, used in constructing walls of a building. Building block 1 has an outer block wall 12 defining outer face 8 and a head 5 with side portions 7. The outer face 8 is a generally flat surface and rectangular in shape defining outer edges 9 which are shorter in length than top and bottom edges 11. The outer edges 9 are generally vertical in orientation and the top and bottom edges 11 are generally horizontal in orientation.

The head 5 on the block extends from the outer block wall 12 on the side opposite the outer face 8 relative to the flat surface. The head 5 extends to define a flat top and bottom surface 13, the inwardly concave sides 15, and the outwardly convex surface 27 in the side portions 7. The convex surface 27 provides a connecting portion and the concave side 15 provides a receiving portion substantially matching in shape to the connecting portion for receiving in interlocking relationship the connecting portion of a co-operating interlocking block.

The end 17 of the head 5 defines a vertical slot 19 which extends from the top surface to the bottom surface such that the slot has a back 21 and two sides 23 that meet to define vertical curved inside corners 29. The sides 23 meet the convex surface 27 to define vertical curved edges 25. Convex surface 27 extends outward and toward the block wall 12 from the corner 25 and joins the concave surface 15 that extends inward and toward the wall 12 such that the block at the head is wider than the block at the side portion but is shorter in width at the head than at the outer face. The convex surface 27 defines a linear curved edge 41 adjacent a curved corner 44 defined by the concave surface 15.

A flange 30 adjoins the concave surface 15 and expands towards the head with a front surface 33 that is parallel to the outer surface 8 that extends to the outer edge 31. The flange 30 functions as an abutment adjacent to the concave surface 15. The junction of the surface 33 and the concave surface 15 define curved corner 46 and curved edge 43. The outer edge 31 of the flange 30 is chamfered preferably in a range from 2 to 4 degrees and optimally at 3 degrees, so as to leave a space of about 2 mm between two abutting blocks thus allowing the introduction of mechanical fasteners 4 between two blocks.

A hole 35 is located at the top surface of the head portion and extends through the block to the bottom surface to define an internal cavity into which concrete or the like can be poured or provided within the block for additional support.

The block body has a top surface and a bottom surface. The convex curved surface 27 referred to above provides a connecting portion on either side of the head shaped to fit into a complementary receiving portion provided by the concave surface 15 of another block, as best shown in FIGS. 1 and 2. The connecting portions are lobe shaped and fit in an interlocking relationship with complementary receiving portions. The abutment portions of front surface 33 defined by the flange 30 are complementary and fit into the vertical slot 19 of another block.

Hence a vertical slot of one block accommodates the abutment portions of two other abutting blocks, as shown in FIGS. 1 and 2.

The vertical corners 29, 44, 46 and vertical edges 25, 41, 43 defined in the block between the various vertical surfaces of the connecting portions and receiving portions are generally rounded, or radius corners and radius edges, preferably with a radius in the range of 6 mm to 12 mm. In contrast, the prior art blocks defined sharp linear corners and linear edges that resulted in tight tolerances between the interlocking portions of the block and resulted in chipping of the blocks during assembly. The rounded or radius corners and radius edges in the present invention overcome these problems and allow for an easier assembly of multiple interlocking blocks and minimize chipping between the interlocking portions of the block. The radius corners and radius edges of the connecting portions and receiving portions allow for some flexion of the blocks in an assembled wall, increasing strength and preventing breakage of the blocks.

Figure 4:
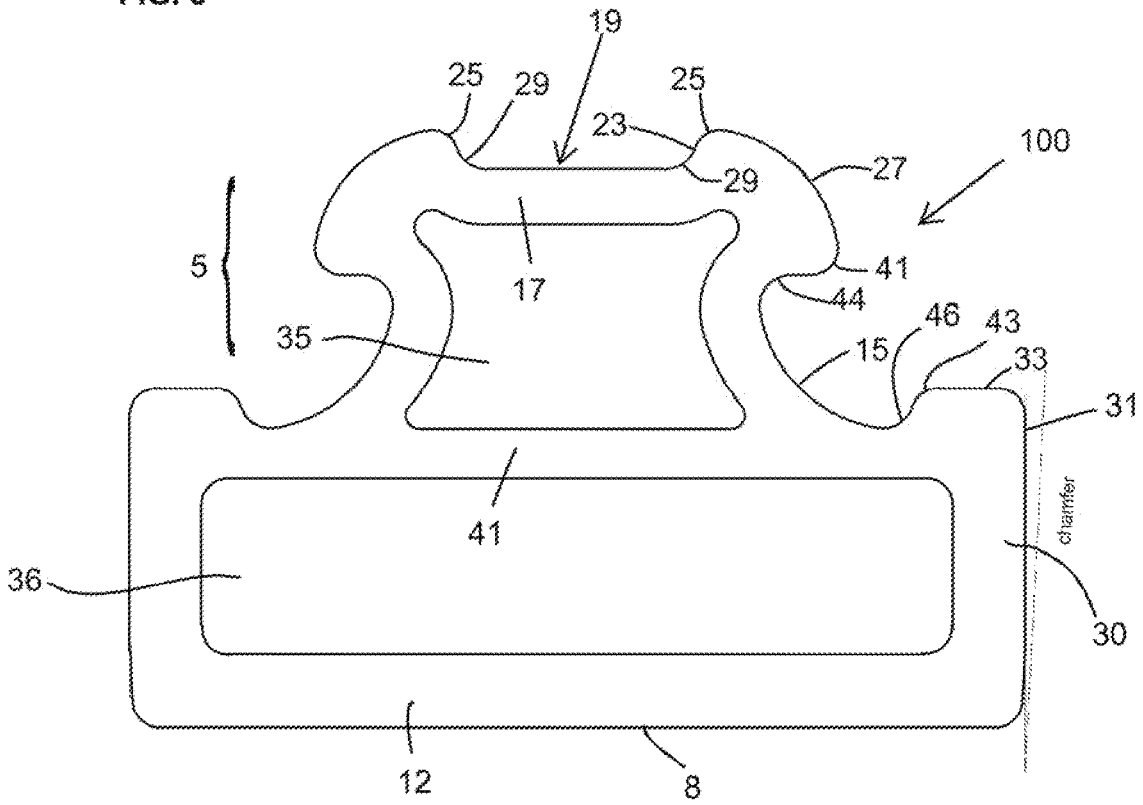
FIG. 4 is a top plan view of another embodiment of a building block of the present invention with increased reinforcement.

Another embodiment of a building block 100 of the present invention is shown in FIG. 4 in which the width of the flange 30 is increased, extending the outer wall 12 of the block further away from the head portion 5 of the block. A separating wall 41 is provided between the outer wall 12 and the head portion 5 to create an additional hollow cavity 36 between the outer wall 12 and head portion 5. The hollow cavity 36 may be filled with insulation material, reinforcing material or may provide passageways for utility conduits.

Figure 5:
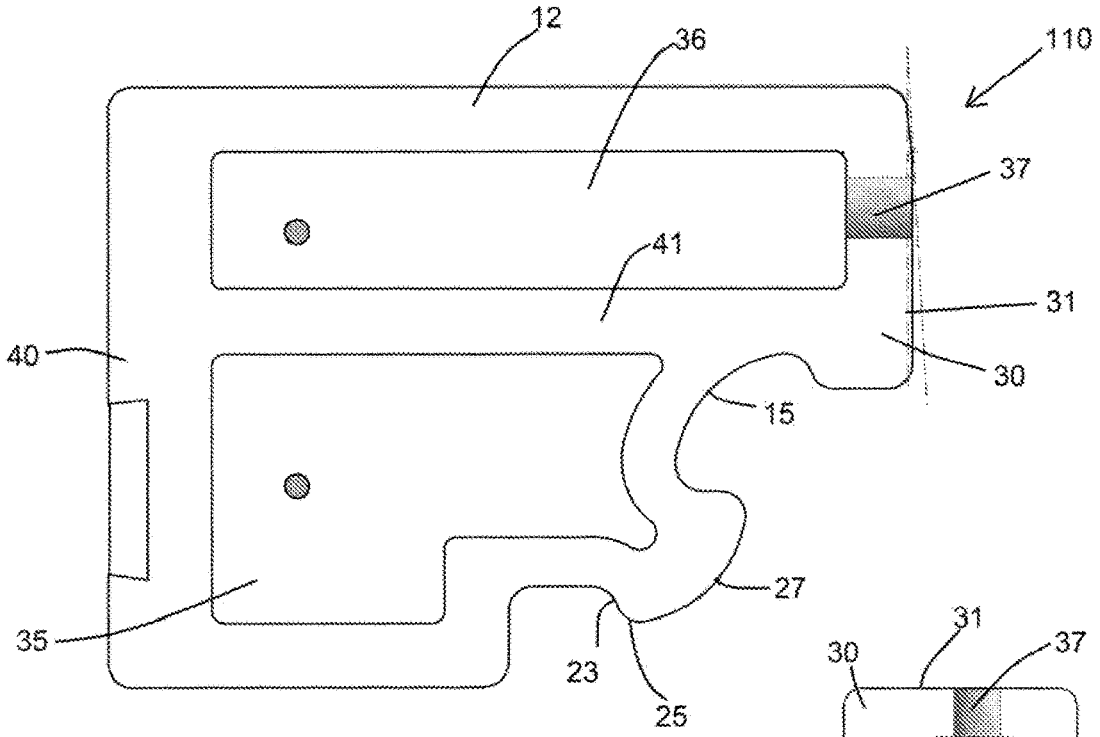
FIG. 5 is a top plan view of an embodiment of an extended end block of the present invention with increased reinforcement.

Another embodiment of a building block 110 of the present invention is shown in FIG. 5, comprising an extended end block with additional hollow cavity 36 resulting from an increased width of the flange 30 and the width of the end wall 40 so as to create the hollow cavity 36 between the head portion and outer wall. A separating wall 41 extends between the head piece and outer wall 12. The hollow cavity 36 may be filled with insulation material, reinforcing material or may provide passageways for utility conduits.

Figure 6:
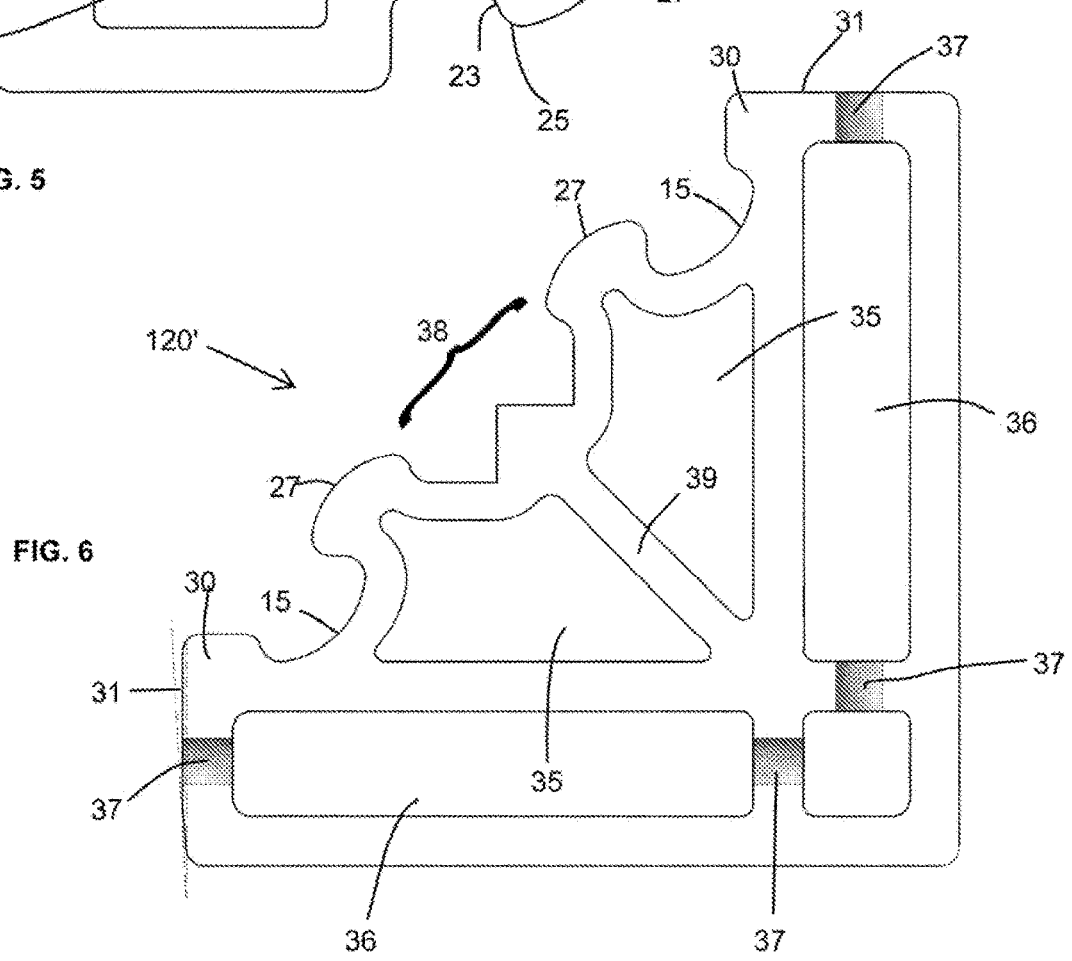
FIG. 6 is a top plan view of an embodiment of a corner block of the present invention with increased reinforcement.

Another embodiment of a building block 120 of the present invention is shown in FIGS. 1 and 6 comprising a corner block that is equivalent to one and a half of the blocks 1, if the other blocks 1 were bisected at approximately a 45-degree angle to remove one lobe shaped connector, abutment portion, and receptable and two of the resulting portions, mirrored in image were connected along the plain of dissection. Block 120 has a "w" shaped channel 38 that runs between both lobe shaped connectors 27 and are configured to retain an abutment portion of another building block on either side of the "w" shaped channel. The corner block includes a connecting piece 39 that runs from a 45-degree angle from the corner of the block to intersect the "w" shaped channel 38. An alternative corner block 120' can also include a hollow cavity 37 that may accommodate rebar reinforcement or utilities such as power or water conduits. The hollow cavity 36 is defined by the extended width of the abutment portions thereby positioning of the outer walls further away from the head portions, and the dividing wall 41 provided between head pieces and outer wall to create a hollow cavity 36 that extends along the outer perimeter of the corner block.

Figure 7:
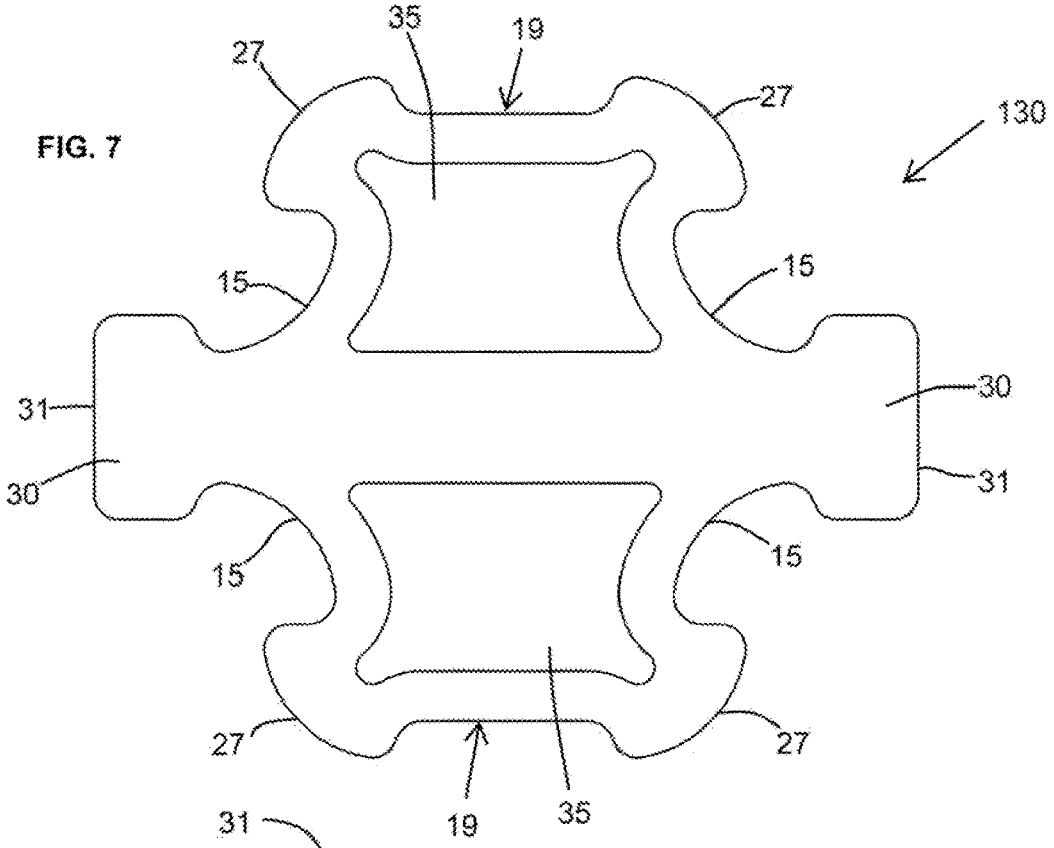
FIG. 7 is a top plan view of an embodiment of a double block of the present invention.

As shown in FIG. 7, a double block 130 is equivalent to two of the other blocks 1, if the other blocks were joined along the outer face.

Figure 8:
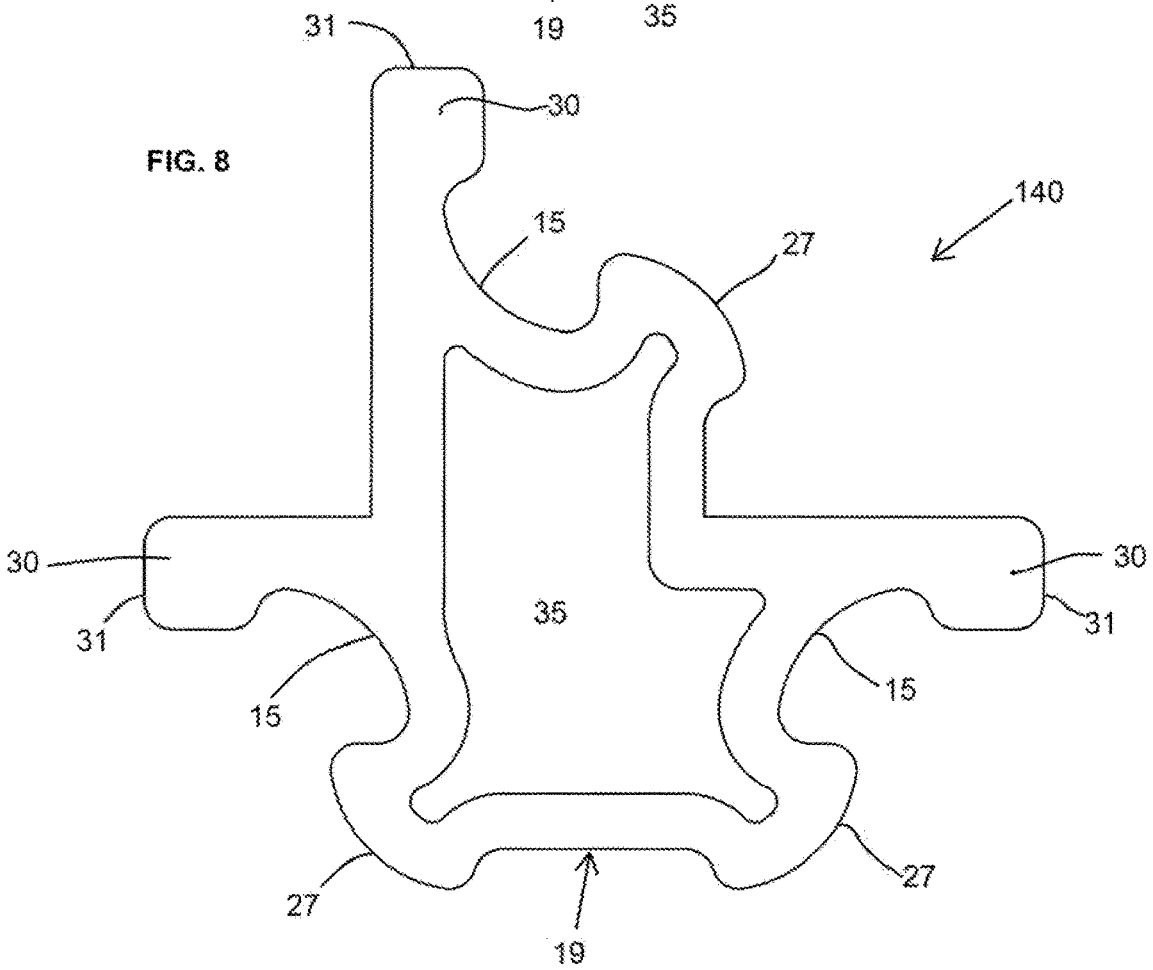
FIG. 8 is a top plan view of and embodiment of an intersecting block of the present invention.

As shown in FIG. 8, an intersecting block 140 that is equivalent to one and a half of the other blocks, configured such that a half block is attached to the outer face of the other block. This block is configured so that the outer wall forms a right angle.

The wall of a building is shown in FIGS. 1 and 2 wherein the concrete block building system is a modular system based on the nominal dimensions of 150 mm wide, 200 mm high, and 399 mm long. The length of the block combined with the chamfered edge creates a 2 mm space between two blocks that allows for the placement of mechanical fasteners between two blocks while maintaining similar dimensions of a standard building block.

FIG. 1 illustrates the placement of mechanical fasteners between the flanges of two blocks to allow claddings to be affixed to the walls. These claddings may consist of insulation or outer or inner wall coverings such as siding or drywall.

While some embodiments of the present invention have been described and illustrated in the foregoing, it is to be understood that other embodiments are possible within the scope of the invention. The invention is to be considered limited by the scope of the appended claims.

The invention claimed is:

1. An interlocking construction block comprising:

a block body having a top surface, a bottom surface, a first outer face and a second outer face, the first and second outer faces meeting at a 90 degree angle to form a corner of the block body;

a first head portion on a side of the block body adjacent to the first outer face, the first head portion defining a first lobe-shaped outwardly convex surface and a first inwardly concave surface;

a first flange having an outer edge at an end of the first outer face that is opposite to the corner of the block body, the first flange being adjacent to the first inwardly concave surface, and extending toward the first head portion and defining an end surface that is perpendicular to the outer edge of the first flange;

a second head portion on a side of the block body adjacent to the second outer face, the second head portion defining a second lobe-shaped outwardly convex surface and a second inwardly concave surface;

a second flange having an outer edge at an end of the second outer face that is opposite to the corner of the block body, the second flange being adjacent to the second inwardly concave surface, and extending toward the second head portion and defining an end surface that is perpendicular to the outer edge of the second flange;

a W-shaped element on an outer surface of the block body between the first lobe-shaped outwardly convex surface and the second lobe-shaped outwardly convex surface, the W-shaped element having:

a first face parallel to the first outer face of the block body;

a second face parallel to the second outer face of the block body;

a third face perpendicular to and adjoining the second face; and a fourth face perpendicular to and adjoining the first face;

wherein the third face and the second face of the W-shaped element and the first lobe-shaped outwardly convex surface form a vertically-extending groove on the outer surface of the block body adjacent to the first lobe-shaped outwardly convex surface; and wherein the fourth face and the first face of the W-shaped element and the second lobe-shaped outwardly convex surface form a vertically-extending groove on the outer surface of the block body adjacent to the second lobe-shaped outwardly convex surface.

* * * * *